United States Patent [19]

Paxon

[11] Patent Number: 5,050,859

[45] Date of Patent: Sep. 24, 1991

[54] VARIABLE SPEED SHEET TRANSPORT SYSTEM

[75] Inventor: James F. Paxon, Rochester, N.Y.

[73] Assignee: Eastman Kodak Company, Rochester, N.Y.

[21] Appl. No.: 539,655

[22] Filed: Jun. 18, 1990

[51] Int. Cl.[5] ..... B65H 5/02

[52] U.S. Cl. ..... 271/270; 271/202

[58] Field of Search ..... 271/270, 202, 203

[56] References Cited

U.S. PATENT DOCUMENTS

| | | | |
|---|---|---|---|
| 2,318,451 | 5/1943 | Belluche et al. | 271/64 |
| 2,852,256 | 9/1958 | Faulls | 271/202 X |
| 4,200,276 | 4/1980 | Marschke | 271/279 |
| 4,453,667 | 6/1984 | Zerfahs | 232/7 |
| 4,461,467 | 7/1984 | Herb | 271/202 |
| 4,585,227 | 4/1986 | Muller | 271/270 |
| 4,598,901 | 7/1986 | Thomas | 271/202 |
| 4,718,656 | 1/1988 | Reist | 271/3.1 |
| 4,913,415 | 4/1990 | Weber | 271/202 X |

*Primary Examiner*—Richard A. Schacher

*Attorney, Agent, or Firm*—Robert L. Randall

[57] ABSTRACT

A conveyor system for transporting sheets between two process stations in hard-copy output apparatus, such as copiers and printers. The system includes a plurality of interleaved belts which extend between the process stations and around rollers of different diameter to selectively raise the belts in a predetermined fashion for contact with the sheet at specific portions along the sheet transfer path. The belts are divided into two groups which operate at different speeds. The faster group receives the sheet from the first process station and moves the sheet to the second group of belts which moves at a slower speed. The speed of the second group can be adjusted by sensing the speed of the sheet in the transition area of the two belt groups to compensate for slippage between the sheet and belts.

15 Claims, 3 Drawing Sheets

VARIABLE SPEED SHEET TRANSPORT SYSTEM

BACKGROUND OF THE INVENTION

1. Field of the Invention

This invention relates, in general, to photocopying apparatus and, more specifically, to vacuum conveyor systems for transporting sheets in copiers and printers.

2. Description of the Prior Art

Hard-copy producing apparatus, such as electrostatographic copiers and printers, often have a number of different process stations through which the produced sheets pass. In order to move the sheets between the stations, various types of transport or conveyor systems are used according to conventional practice. One type widely used in the industry employs conveyor belts which are disposed over a vacuum system which effectively attracts the sheets to the belts. These vacuum belt systems are sufficient in many types of apparatus, but, without changes, they offer little control over the speed of the sheet as it is moved by the conveyor system.

One frequent location for a vacuum transport system is between the transfer station, where the toner is transferred to the sheet, and the fixing or fusing station, where the transferred toner is melted and fused to the sheet. In some applications, the conveyor system between these stations even transports the sheet in an upside down orientation before the toner is fused to the paper or transparency sheet. While the vacuum transport system does a good job in some applications, conventional systems do not provide all of the versatility desired in some forms of hard-copy producing apparatus.

Matching the speed from one process station to another is important so that the paper sheet passes smoothly between the two process stations. In the case of a multipurpose machine which can produce color and monochrome copies or prints, the speed of the transfer station is often different than the speed of the fuser. For example, the transfer station may operate at a speed of 12 inches per second (ips) when sheets are delivered to the conveyor in both the monochrome and color modes. However, because of the need for multicolor transfer operations, the number of sheets delivered in the color mode on an average basis is less than that for the monochrome mode. This permits the use of a slower fuser speed to achieve better quality fusing. For transparencies, a fuser speed of 2 ips is typical. In order to accomplish smooth sheet transfers, some form of sheet slowing between the transfer and fusing stations is necessary because the fuser runs slower than the transfer station.

One method customarily used in the prior art involves reducing the vacuum on the belts to cause the sheet to slip on the belt and arrive at the fuser later than normal. This effectively slows the sheet and allows it to pass smoothly into the fusing station at substantially the same speed as the fuser. Such conditions and parameters as electrostatic charge on the paper, marking engine operating altitude, paper roughness, moisture content, and grain orientation all affect the amount of slippage of the sheet on the belts, in addition to the slip caused by the reduced vacuum. Thus, exact and precise control over the paper sheet is difficult to obtain with only the vacuum changes. In addition, if the vacuum becomes too low, maintaining the proper paper path can become difficult. This is especially important and troublesome when the paper is being transported along the bottom of the belts and may drop off if the vacuum becomes too low.

Therefore, it is desirable, and an object of this invention, to provide a variable speed transport system which can smoothly and predictably change the speed of a sheet being conveyed between two process stations in a copier, printer, or like apparatus.

SUMMARY OF THE INVENTION

There is disclosed herein a new and useful sheet transport system for hard-copy output apparatus, such as copiers and printers. The transport system moves the sheet between a process station running at one speed, such as a transfer station, and another process station running at a different speed, such as a fixing or fusing station. Such speed differences are usually experienced when the apparatus is producing color or transparency output sheets.

According to a specific embodiment of the invention, the transport system includes two groups of belts which are disposed around rollers or circular members to form flat, elongated surfaces which transport the paper when the belts are rotated around the rollers. One group of belts is driven at a linear speed which is substantially equal to the sheet exit speed from the transfer station. The other group of belts is driven at a linear speed which is substantially equal to the desired entry speed of the sheet into the fusing station. The two groups of belts are driven by different moving sources, with the group leading to the fuser running at the slower speed. This speed is adjusted and maintained by a control circuit which senses the speed of the sheet as it travels between the two process stations. In order to accurately match the sheet speed with the fuser speed, the sensed speed information gives an indication of the amount of slippage of the sheet on the belts caused by a variety of condition factors. If needed, the speed of the group of belts leading to the fuser is changed to make the sheet arrive at the fuser at the desired speed.

The belts are interleaved with each other and positioned around the rollers or circular members in a specific fashion to provide a smooth transfer in the speed of the sheet as it travels between the process stations. One group of belts is disposed over rollers having a larger diameter than the rollers around which the other group of belts is disposed at that location. All of the rollers at each end of the belts are aligned to rotate around the same axis. The opposite situation exists at the other end of the belts so that the area of contact between the belts and the sheet changes from one group to the other group in the middle of the sheet path. The change occurs over a fixed distance of belt overlap and provides for a smooth transition of the sheet from one speed to another.

By using the transport system of this invention, the sheet speed is smoothly changed without having to quickly change the speed of the conveying belts. This allows the apparatus to operate with less vibration and wear and reduces the chance that the unfixed toner on the sheet will be disturbed by the sheet transport system.

BRIEF DESCRIPTION OF THE DRAWINGS

Further advantages and uses of this invention will become more apparent when considered in view of the following detailed description and drawings, in which.

DESCRIPTION OF THE PREFERRED EMBODIMENTS

Figure 1:
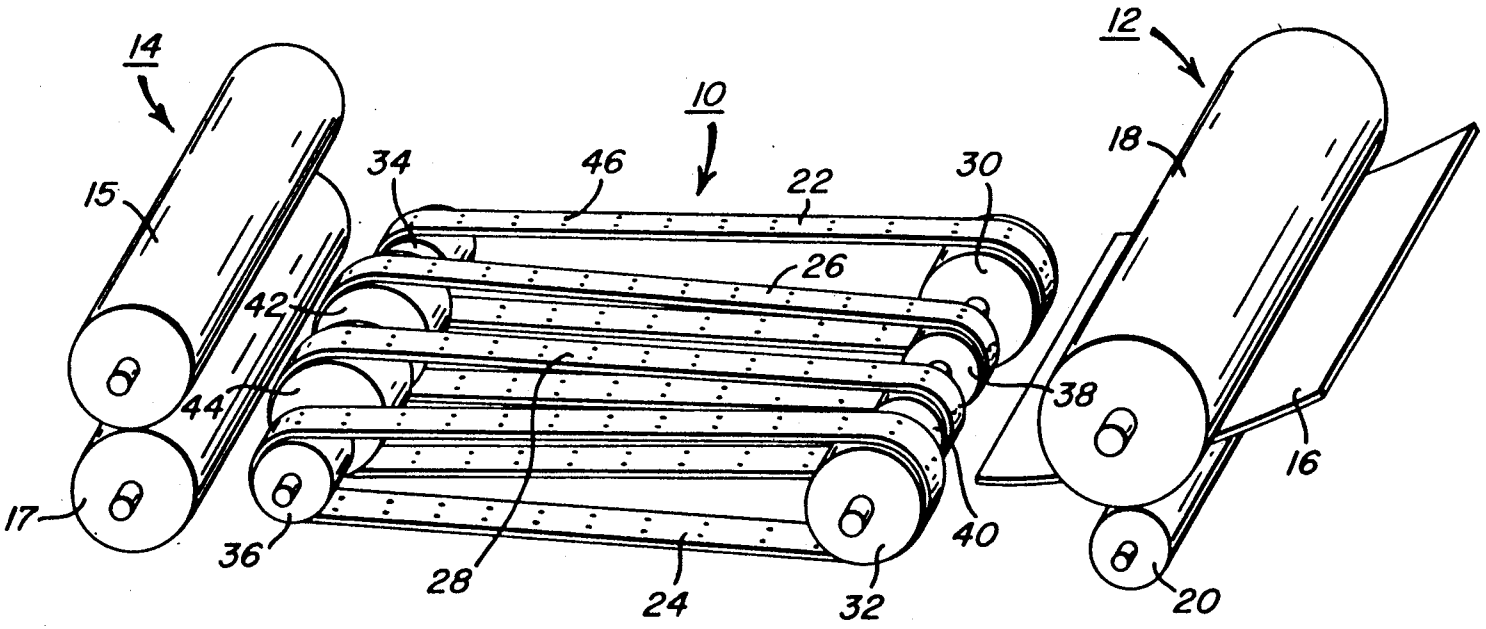
FIG. 1 is an isometric view of the sheet transport system of this invention located between two process stations.

Throughout the following description, similar reference characters refer to similar elements or members in all of the figures of the drawings.

Referring now to the drawings, and to FIG. 1 in particular, there is shown an isometric view of a conveyor system constructed according to this invention. The conveyor or transport system 10 is positioned between two process stations of a copier or printer, or like apparatus. In this embodiment, the transport system 10 is positioned between the transfer station 12 and the fixing or fusing station 14. The transfer station 12 is assumed to be operating in a mode in which the hard-copy sheet 16 is delivered to the transport system 10 at a speed which is greater than the speed at which the fusing station 14 is running and can easily accept sheets from the transport system 10. The transfer station 12 includes the photosensitive drum 18 and the transfer roller 20 which rotate in a direction to move the sheet 16 toward the transport system 10 while toner on the photosensitive member or drum 18 is transferred to the sheet 16. The fusing station 14 includes the fusing rollers 15 and 17 which cooperate to apply heat and force to the toner on the sheet 16. The sheet 16, with the toner on the top side thereof, is delivered to the transport system 10 and placed upon the belts of the transport system. In this specific embodiment, the sheet is placed upon the top of the belts contained in the transport system 10. It is emphasized that, in a particular application, the sheet 16 may be delivered to the underneath side of the belts in transport system 10 for transport to the fixing station 14. This would usually occur when the photosensitive member 18 and the transfer roller 20 are interchanged from the respective locations shown in FIG. 1 such that the toner is applied to the underneath side of the sheet 16. Regardless of the position of the paper with respect to the top or bottom side of the transport system, the function of the transport system 10 is to convey the sheets from one process station to another process station and perform an accurate and predictable speed change smoothly upon the sheet when travelling between the two process stations.

The transport system 10 shown in FIG. 1 includes the vacuum conveyor belts 22, 24, 26 and 28. These belts are interleaved with each other in a fashion which allows the belts to, at some time during the sheet transport, separately come in contact with the sheet 16. Belts 22 and 24 form one group of belts which are disposed around the circular members or rollers 30, 32, 34 and 36, as illustrated in FIG. 1. As also illustrated, the belts 26 and 28 are disposed around the rollers 38, 40, 42 and 44. For example, one end region of belt 22 is disposed around roller 30 and the other end region of belt 22 is disposed around roller 34. It is noted that the diameter of the rollers 30, 32, 42 and 44 is larger than the diameter of the rollers 34, 36, 38 and 40. Since the diameters are different, and since all of the rollers at the same end of the transport system 10 rotate around a common axis, the effective height or contact area of the belts depends upon which group of belts is nearest to the larger diameter rollers. In other words, the belts 22 and 24 would support the sheet 16 when it is first delivered from the transfer station 12 since the belts 26 and 28 are, because of the smaller diameter rollers 38 and 40, underneath the surface of the belts 22 and 24 at this end of the conveyor system 10. Thus, the transport of the sheet 16 is provided solely by the belts 22 and 24 at this end of the transport or conveyor system 10.

The other end of the transport or conveyor system 10 has the ends of the belts disposed over rollers of the opposite diameter. In other words, the outside belts, belts 22 and 24, are disposed over the smaller rollers 34 and 36, whereas the inside belts 26 and 28 are disposed over the larger rollers 42 and 44. All of the rollers at the fuser end of the transport system 10 also rotate around a common axis of rotation. Consequently, the belts 26 and 28 will be supporting the sheet 16 when it is ready to be delivered to the fixing station 14. As should be evident, there is a transition area centered at the middle of the belts in which the transporting of the sheet 16 will be transferred from the belts 22 and 24 to the belts 26 and 28. As will be described in connection with other figures in the drawings, the belts 22 and 24 operate at a faster or greater linear speed than the linear speed of the belts 26 and 28. Thus, the sheet 16 is smoothly slowed through the transition area and acquires the speed of the belts 26 and 28, less any induced slippage, before entry into the fusing station 14. The holes in the belts, such as hole 46, enable a vacuum system disposed underneath the belts to cause the paper sheet 16 to adhere tightly to the belts during movement. The vacuum system is not shown in FIG. 1 and would be useful especially in applications where the sheet 16 is supported from the underneath side of the transport system 10.

Figure 2:
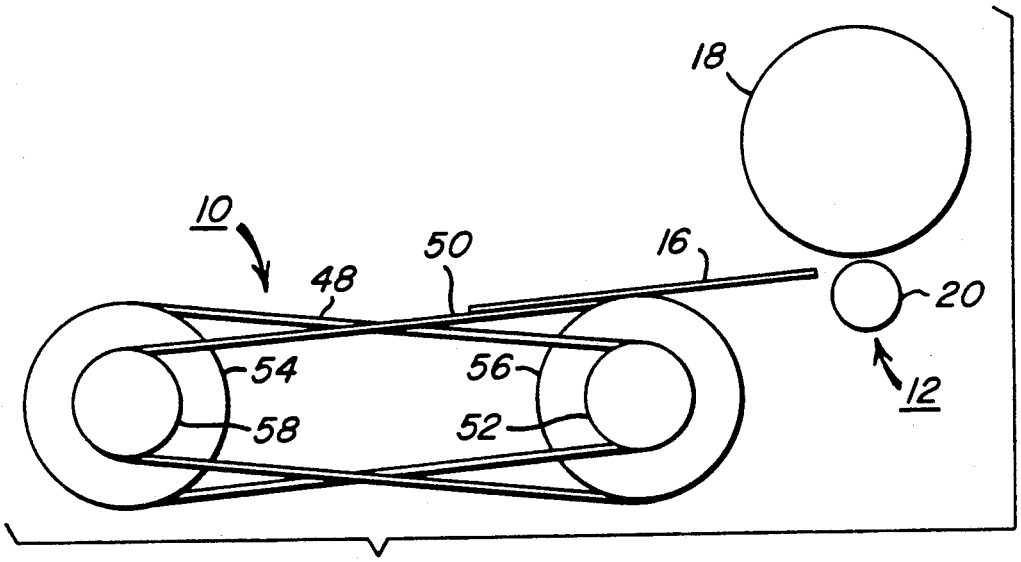
FIG. 2 illustrates the operation of the transport system when receiving a sheet from a process station.

FIG. 2 illustrates the operation of the transport system 10 during the portion of time it is receiving a sheet from the process station 12. Belt group 48 in FIG. 2 schematically represents the belts 26 and 28 in FIG. 1. These are disposed over the smaller diameter rollers 52 and the larger diameter rollers 54 which are equivalent schematically to the smaller rollers 38 and 40, and the larger rollers 42 and 44, shown in FIG. 1. By a similar analysis, the belt group 50 is equivalent to the belts 22 and 24 in FIG. 1, the roller 56 is equivalent to the rollers 30 and 32, and the roller 58 is equivalent to the rollers 34 and 36 shown in FIG. 1.

FIG. 2 illustrates that when the sheet 16 is first delivered to the transport system 10, the belt group 50 provides the conveying force on the sheet 16 since the belt group 48 is not in contact with the sheet 16. Since belt group 50 rotates at a speed which provides a linear speed of the belt equivalent to the output speed of the transfer station 12, the sheet enters the transport system smoothly at the same speed of the output of the transfer station 12. Linear speed refers to the speed of the flat belt surface.

Figure 3:
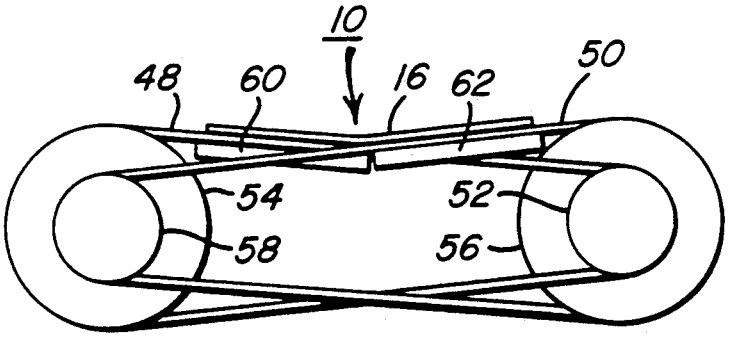
FIG. 3 illustrates the operation of the transport system during transfer of a sheet between process stations.

FIG. 3 illustrates the operation of the transport system when the sheet 16 is at a position between the two process stations. At this position, the sheet 16 is partially in contact with both the belt groups 48 and 50. Therefore, the movement of the sheet 16 is affected by the linear speed of both the belt groups 48 and 50. Boxes 60 and 62 underneath the belt groups represent the vacuum system used in the transport device. In order for the transition to occur smoothly, it is desirable, in many applications, to reduce the vacuum on the underneath side of the belt groups so that there is some slippage between the belts and the paper sheet 16. Thus, there is a transition area wherein the sheet 16 moves slower than the linear speed of the belt group 50 and faster than the linear speed of the belt group 48. Even without reducing the vacuum on the belt groups, logic dictates that there must be some slippage with respect to the belts and the paper sheet 16 when the sheet is driven by two different belt systems at two different speeds, assuming that the attraction to the belts is not so great that the paper would tend to buckle in the middle.

Figure 4:
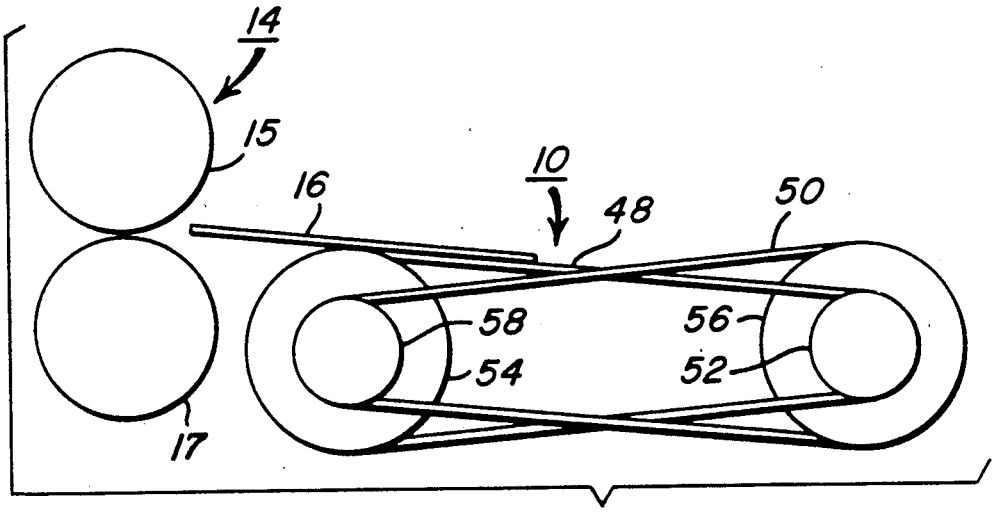
FIG. 4 illustrates the operation of the transport system when delivering a sheet to a process station.

FIG. 4 illustrates the operation of the transport system 10 when the sheet 16 has substantially passed the transition area and is ready for delivery to the fusing station 14. At this time, the sheet 16 is transported or conveyed solely by the belt group 48, which is travelling at a lower linear speed than the belt group 50. Thus, the speed of the sheet 16 has been slowed to the speed of the fuser station 14 smoothly through the transition area shown primarily in FIG. 3. By using this arrangement, the conveyor groups can be operated continuously at substantially a constant speed and still smoothly and effectively slow the sheet 16 down before it enters the fusing station 14. This arrangement also provides for a compact and small conveyor system which does not have overlapping or serially staggered belt systems operating at different speeds.

Figure 5:
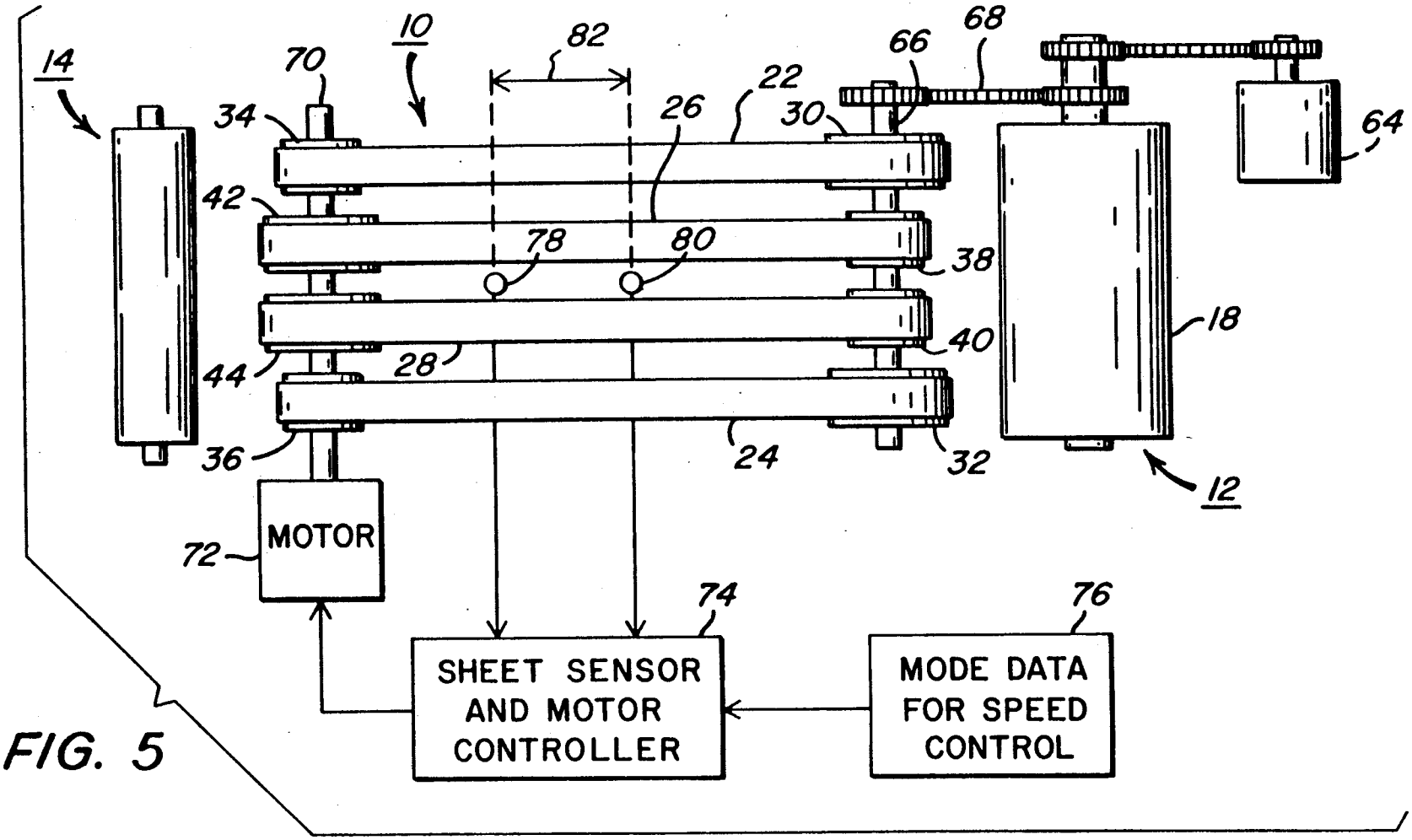
FIG. 5 illustrates the transport system of this invention with its associated drive and control components.

FIG. 5 illustrates the transport system of this invention along with associated control devices for adding additional versatility to the transport system. In FIG. 5, the transport system 10 also includes a speed sensing device which senses the speed of the sheet passing through the transition area to permit adjustment of the speed of the belt group which will deliver the sheet to the fusing system 14. In this embodiment, the motor 64 is mechanically coupled to the photosensitive member 18 and a similar mechanical coupling between the photosensitive member 18 and the drive shaft 66 is provided by the chain 68. Thus, the shaft 66 rotates at a speed which is directly proportional to the speed of rotation of the member 18. The gearing is selected to produce a linear speed for the belts 22 and 24 which is substantially equal to the speed of a sheet passing through the transfer station 12, which may not necessarily be a one-to-one rotational speed ratio between the shaft 16 and the member 18.

Circular members or rollers 30 and 32 are keyed or connected to the shaft 16 such that they rotate at the same speed as the shaft 66. Circular members or rollers 38 and 40, although disposed on the shaft 66 so that they have the same rotational axis as the rollers 30 and 32, are not pinned or secured to the shaft 66 and effectively idle around the shaft 66. Thus, the rotational speed of the shaft 66 does not affect the speed of movement of the belts 26 and 28. At the other end of the transport system 10, the rollers 34 and 36 are not secured to the shaft 70 but are allowed to idle thereon so that the belts 22 and 24 are free to move at a velocity determined by the movement of the rollers 30 and 32. On the other hand, rollers 42 and 44 are pinned or secured to the shaft 70 so that the rotation of belts 26 and 28 is determined by the speed of rotation of the shaft 70.

The shaft 70 is rotated by the prime moving source or motor 72 which is controlled from the sheet sensor and motor controller 74. This controller acquires mode data from the block 76 and speed data from the sensors 78 and 80 which are located along the sheet path provided by the transport system 10. The purpose of the controller 74 is to regulate the speed of the motor 72 to move the belts 26 and 28 at the proper speed for delivery of the sheet to the fuser 14 at the appropriate time. The sensors 78 and 80 provide an added measure of speed control over and above that which could be accomplished by simply running the shaft 70 at a slower speed than the shaft 66. Even though, in some applications, simply operating the shafts at different speeds would provide adequate sheet transport, changes in operating conditions will cause the slippage of the sheet on the conveyor belts to be different at different times. Sensing the speed by the sensors 78 and 80 will allow the intelligent controller 74 to compensate for the sheet slippage.

The speed sensors function by detecting the leading edge of the sheet 16, which is not shown in FIG. 5, as it is moved by the transport system 10. Since the distance 82 between the sensors 78 and 80 is fixed, and since the time of detection of the sheet edge can be sensed, the speed is calculated accurately by the controller 74. The controller can then go to a lookup table which tells what speed the conveyor belts 26 and 28 need to be moved at to deliver the sheet to the fuser 14 at the correct speed. The lookup table contains values which have been precalculated or predetermined to give the desired speed depending upon the speed of the sheet at the time it is measured by the sensors 78 and 80. Of course, the speed of the sheet to be delivered to the process station 14 is also dependent upon the mode of operation of the apparatus, which is given by the information from block 76. The sensors 78 and 80 can be any of the forms of detecting sensors conveniently used for sheet edge detection, such as optical photoelectric sensors and finger or mechanical switch activators. Thus, with the refined control of the motor 72 by the controller 74, the speed of the sheet can be controlled such that it enters the process station 14 at precisely the correct and lower speed regardless of the amount of slippage variations occurring during the travel of the sheet across the transport system 10.

Figure 6:
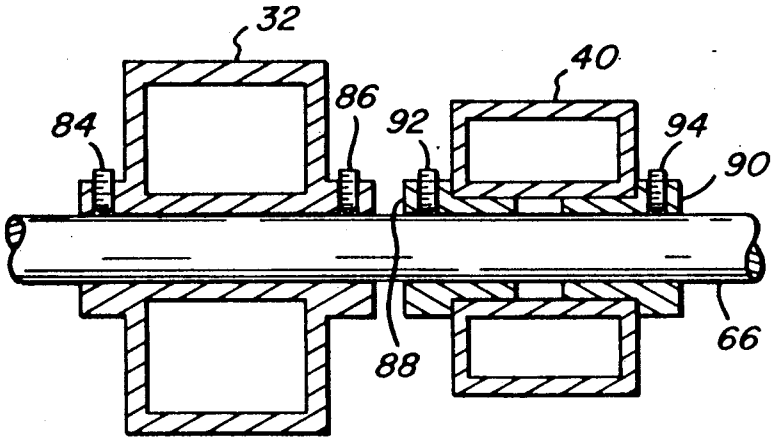
FIG. 6 is a partial sectional view illustrating one arrangement for connecting idler and drive rollers to a shaft.

FIG. 6 is a partial sectional view illustrating one arrangement for connecting the idler and drive rollers to the shafts. In this partial illustration, the roller 32 is secured to the shaft 66 by the set screws 84 and 86. Thus, roller 32 rotates at the same speed as the shaft 66. On the other hand, roller 40 is positioned around bushings or collars 88 and 90 which are secured to the shaft 66 by the set screws 92 and 94, respectively. Thus, the roller 40 is fixed as far as axial movement along the shaft 66, but is free to rotate independently of the rotation of the shaft 66. Although this arrangement for roller connection to the shaft would function adequately for the device shown in FIG. 5, other arrangements for connecting the idler and drive rollers to the shaft may be used without departing from the invention.

The transport system described herein permits a compact conveyor system to be positioned between two process stations which operate at different speeds and smoothly slow the sheet it transports down to a slower speed before it is delivered to the slower process station. This can be accomplished without the need to abruptly change the speed of any of the conveyor belts, or to abruptly hand off the sheet from one conveyor system to another. Additional control of the conveyor system is provided by a speed sensing device to compensate for variations in sheet slippage depending upon conditions.

It is emphasized that numerous changes may be made in the above-described system without departing from the teachings of the invention. It is intended that all of the matter contained in the foregoing description, or shown in the accompanying drawings, shall be interpreted as illustrative rather than limiting.

I claim as my invention:

1. A sheet transport system for conveying a sheet from a first process station of a hard-copy output machine to a second process station of the machine, said system comprising:

a plurality of belts positioned between the first and second process stations;

first means for moving a predetermined number of the belts at a first linear speed which is substantially equal to the discharge speed of a sheet from the first process station;

second means for moving a predetermined number of the belts, other than those moved by the first moving means, at a second linear speed;

all of the belts being of substantially the same length and each belt being disposed around a circular member at each end of the belt;

all of the circular members at one end of all the belts being rotatable about a first common axis, and with all of the circular members at the other end of all the belts being rotatable about a second common axis;

means for sensing the speed of a sheet being moved between the process stations by the transport system; and means for controlling the second moving means such that the second linear speed is a function of the sensed speed of the sheet.

2. The sheet transport system of claim 1 wherein the belts are positioned with respect to each other such that the sheet is first conveyed by the belts moving at the first linear speed and is then conveyed by the belts moving at the second linear speed, and wherein there is a transition area along the belts where the sheet is gradually changed from substantially the first linear speed to substantially the second linear speed.

3. The sheet transport system of claim 1 wherein the belts which move at the first linear speed are positioned to be in contact with the sheet when it is first received from the first process station, and the belts which move at the second linear speed are positioned to not be in contact with the sheet when it is first received from the first process station.

4. The sheet transport system of claim 1 wherein the belts which move at the second linear speed are positioned to be in contact with the sheet when it is ready to be delivered to the second process station, and the belts which move at the first linear speed are positioned to not be in contact with the sheet when it is ready to be delivered to the second process station.

5. The sheet transport system of claim 1 wherein at least some of the circular members positioned around the first common axis have different diameters, with the belts moving at the first linear speed being disposed around circular members which have a larger diameter than the circular members around which the belts moving at the second linear speed are disposed.

6. The sheet transport system of claim 5 wherein at least some of the circular members positioned around the second common axis have different diameters, with the belts moving at the first linear speed being disposed around circular members which have a smaller diameter than the circular members around which the belts moving at the second linear speed are disposed.

7. The sheet transport system of claim 1 wherein the means for moving the belts at a second linear speed uses a prime moving source to drive said belts, said moving source being separate from the moving source for the first process station.

8. The sheet transport system of claim 2 wherein at least a portion of the speed sensing means is located at the transition area along the belts.

9. The sheet transport system of claim 8 wherein the speed sensing means includes first and second sensors positioned to sense an edge of the sheet at two different positions along the belts at the transition area.

10. The sheet transport system of claim 1 wherein the sensed speed of the sheet is used to set the second linear speed of the belts such that the sheet is delivered to the second process station at a speed which substantially matches the input speed of said station.

11. A sheet transport system for conveying a sheet from a first process station of a hard-copy output machine to a second process station of the machine, said system comprising:

a plurality of interleaved belts positioned between the first and second process stations;

a first plurality of circular members located adjacent to the first process station;

a second plurality of circular members located adjacent to the second process station, with all of said first circular members being rotatable around a common first axis and having two different diameters, and with all of said second circular members being rotatable around a common second axis and having two different diameters;

a first group of the belts being disposed around the first axis circular members which have the larger diameter and the second axis circular members which have the smaller diameter;

a second group of the belts being disposed around the first axis circular members which have the smaller diameter and the second axis circular members which have the larger diameter;

means for moving the first and second groups of belts at different linear speeds; and means for sensing the speed of a sheet being moved between the process stations by the transport system.

12. The sheet transport system of claim 11 wherein the means for moving the belt groups moves one of the groups of belts at a speed substantially equal to the sheet exit speed of the first process station, and the means for moving the belt groups moves the other of the groups of belts at a speed substantially equal to the sheet entry speed of the second process station.

13. The sheet transport system of claim 11 wherein the system also includes means for controlling the speed of the second group of belts as a function of the sensed speed.

14. A sheet transport system for conveying an image carrying sheet along a path from an image transfer station of an electrostatographic machine to an image fixing station of the machine, said transfer station operable at a higher speed than said fixing station thereby requiring the sheet to be slowed by the transport system, said transport system comprising:

first and second groups of equal length belts each shaped to have two end regions;

a plurality of first circular members around which one end region of each belt is disposed;

a plurality of second circular members around which the other end region of each belt is disposed;

all of said first circular members being rotatable about a first axis located adjacent to the transfer station, and all of said second circular members being rotatable about a second axis located adjacent to the fixing station;

said first and second circular members which are rotatable about the same axis having first and second diameters;

said first group of belts being disposed around the first circular members having the first diameter and around the second circular members having the second diameter;

said second group of belts being disposed around the first circular members having the second diameter and around the second circular members having the first diameter;

means for moving the first and second groups of belts at different linear speeds;

means for sensing the speed of the sheet being moved along the path; and means for controlling the speed of one of the groups of belts based upon the sensed speed.

15. The sheet transport system of claim 14 wherein the first group of belts is moved at a linear speed which is substantially equal to the exit speed of a sheet from the transfer station, and the second group of belts is moved at a linear speed which is substantially equal to the entry speed of a sheet to the fixing station, with said speed controlling means adjusting the speed of the second group of belts to compensate for slippage of the sheet on the belts.

* * * * *